United States Patent [19]

Johnson, Jr.

[11] Patent Number: 4,831,777

[45] Date of Patent: May 23, 1989

[54] ADJUSTABLE WIDTH DOORWAY SAFETY GATE APPARATUS

[75] Inventor: Stanley A. Johnson, Jr., Brookfield, Wis.

[73] Assignee: Nu-Line Industries Co., Suring, Wis.

[21] Appl. No.: 158,923

[22] Filed: Feb. 22, 1988

Related U.S. Application Data

[63] Continuation-in-part of Ser. No. 83,037, Aug. 6, 1987, Pat. No. 4,777,765, which is a continuation-in-part of Ser. No. 870,550, Jun. 4, 1986, Pat. No. 4,702,036.

[51] Int. Cl.[4] ..... E06B 3/68

[52] U.S. Cl. ..... 49/55; 49/505; 160/228

[58] Field of Search ..... 49/55, 57, 56, 505; 160/222–228, 215, 216

[56] References Cited

U.S. PATENT DOCUMENTS

| | | | |
|---|---|---|---|
| 139,232 | 5/1873 | Boughton . | |
| 141,677 | 8/1873 | Tuttle . | |
| 942,502 | 12/1909 | Jablonovsky . | |
| 2,574,807 | 11/1951 | Woodruff | 49/55 |
| 2,662,242 | 12/1953 | Hess | 16/176 |
| 2,896,277 | 7/1959 | Halligan | 20/71 |
| 2,998,063 | 8/1961 | Hafner | 160/216 |
| 3,420,003 | 1/1969 | Cline | 49/505 |
| 3,545,135 | 12/1970 | Lieber | 49/505 |
| 3,906,671 | 9/1975 | Maldonado | 49/505 |
| 4,149,342 | 4/1979 | Bowers | 49/55 |
| 4,465,262 | 8/1984 | Itri | 256/24 |
| 4,492,263 | 1/1985 | Gebhard | 160/228 |
| 4,566,222 | 1/1986 | Hatvany | 49/56 |
| 4,573,285 | 3/1986 | Jokel | 49/55 |
| 4,607,455 | 8/1986 | Bluem | 49/55 |
| 4,677,791 | 7/1987 | Larson | 49/463 |
| 4,702,036 | 10/1987 | Johnson | 49/55 |

FOREIGN PATENT DOCUMENTS

| | | |
|---|---|---|
| 1236542 | 6/1960 | France . |
| 2041051 | 9/1980 | United Kingdom . |

*Primary Examiner*—Philip C. Kannan
*Attorney, Agent, or Firm*—Robert T. Johnson

[57] ABSTRACT

Adjustable width doorway safety gate apparatus comprising two gate segments, one segment of which is laterally slidable on the other or hinged gate half segment, and the gate half segments having tongues and grooves and held in lateral sliding position by means of double headed pins extending through slots in top and bottom bar sections and spring section latch means of stiffly flexible plastic material to lock the gates in adjusted width and the gate is mounted on hinges of downward pointing hinge pin fitting in hinge pin socket and the hinge pin sockets attached to a face plate assembled of two sections one having slits and the other section having offset fingers and the fingers fitting in the slits and side wings on face plate with adjusting screws in the side wings of the face plate to attach the face plate to a doorway pillar.

8 Claims, 7 Drawing Sheets

(SECTION A-A)

(SECTION C-C)
(OF FIG. 1)

(SECTION E-E)

(SECTION D-D)
(OF FIG. 2)

(SECTION B-B, F-F)

(SECTION H-H)

(VIEW J-J)

(SECTION G-G)

(SECTION K-K)

(SECTION M-M)

(VIEW N-N)

ADJUSTABLE WIDTH DOORWAY SAFETY GATE APPARATUS

This application is a continuation-in-part of application Ser. No. 083,037 filed on Aug. 6, 1987, now U.S. Pat. No. 4,777,765 issued Oct. 18, 1988 and which was in turn a continuation-in-part of application Ser. No. 870,550 filed June 4, 1986 and is now U.S. Pat. No. 4,702,036, issued Oct. 27, 1987.

DESCRIPTION OF INVENTION

Safety gates are of major importance in protection of infants to prevent their wandering out of a room and into areas where they might be injured such as falling down stairs.

This invention pertains to a doorway safety gate comprised of two segments laterally sliding one on the other to adjust to a doorway width, and the safety gate is mounted on hinges on one gate end and the opposite gate end having legs of U frame sections that straddle the doorway pillar opposite the hinge mounted doorway pillar.

As will be described below, the gate segments can be molded of plastic and have tongue and grooves molded therein so that a one cavity molding will produce segments that fit together for lateral sliding when the tongues and grooves mesh and the segments are held together by means of pins extending through matching slots in the upper and lower sections of the gate segments.

Molded segments from one die are fitted together, as outlined above for fitting of tongues and grooves, and slots by inverting one segment to match the other segment for fitting together of the tongues and grooves.

further disclosure is made of a rack gear tooth section and a gate latch lock having a gear tooth section mounted on a spring loaded release lever so that the lateral sliding gate segment is extendible without release of the gear tooth section from the rack gear tooth section but release of the gear tooth section by action of spring loaded release lever is required to allow lateral movement of the gate segment in an inward direction to allow passage through the doorway. The spring loaded gate latch lock section is stiffly flexible, molded of a plastic material such as nylon, polypropylene or polystyrene.

To hold the adjusted width safety gate across a doorway there are legs of U frame sections extending horizontally outward and attached to the outer vertical frame section of the lateral sliding gate half segment, which legs straddle the doorway pillar.

For convenience in the description of this invention, the legs straddling the door frame pillar are referred to as U frame sections but in reality the shape of the legs and their base is square to allow for adjustment of width of the legs to straddle the doorway pillar.

OBJECTS OF INVENTION

An object of this invention is to disclose an adjustable width safety gate comprised of two gate segments, one segment laterally slidable on the other, and fastened together by means of pins extending through matching slots of the gate segments and matching tongues and grooves of the gate segments, and a rack gear or saw tooth section of one gate segment which tooth section meshes in part with a lock having a matching gear or saw teeth section.

Another object of this invention is to disclose an adjustable width safety gate locked in extended position by means of meshing of rack gear teeth on a gate segment with a gate latch lock having a matching gear or tooth section mounted on a spring section, and a release lever attached to the spring section, to disengage meshing of the teeth to allow laterally movable gate segment to retract from the full width of a doorway to allow passage through the doorway.

Another object of this invention is to disclose two gate segments aligned and attached together for lateral sliding of one gate segment on the other and these two gate segments having lateral slots in top bar sections and bottom bar sections of each gate segment and cross pins extending through the lateral slots of aligned gate segments. The top bar sections, center bar sections and bottom bar sections of the two gate segments fitting together in matching tongues and grooves for lateral sliding and rack gear teeth mounted in the length of slot of the top bar section of the gate segment mounted on hinges comprised of downward projecting hinge pins mounted on outer vertical gate segment and the hinge pins mounting into hinge pin sockets and the hinge pin sockets attached to a face plate mounted on the door frame pillar.

Another object of this invention is to disclose adjustable width doorway safety gate apparatus comprised of two gate segments, one segment mounted on hinges and one segment mounted for lateral sliding on the segment mounted on hinges and the two gate segments having matching lateral slots in top bar sections and bottom bar sections and double headed ross pins extending through the lateral slots of aligned gate segments and top bar sections, center bar sections, and bottom bar sections of the two gate segments fitting together in matching tongues and grooves for lateral sliding and rack gear teeth mounted in the length of slot of top bar section of gate segment mounted on hinges, and gate latch lock means to engage the rack gear teeth of hinge mounted gate segment to stop inward lateral movement of sliding gate segment, the gate latch lock means comprising a section of gear teeth to mesh with rack gear teeth and the section of gear teeth mounted on spring means to mesh with the rack gear tooth section and a release lever attached to the spring means to disengage gear teeth section from the rack gear teeth to allow lateral inward movement of sliding gate segment and door pillar straddle U sections attached to outer vertical edge of the lateral sliding gate segment to hold gate in closed position.

Another object of this invention is to disclose an adjustable width doorway safety gate apparatus comprising two gate segments, one segment mounted on hinges and one segment mounted for lateral sliding on the segment mounted on hinges and means to engage rack gear teeth mounted in the length of slot of top bar section to stop inward lateral movement the means consisting of gear teeth section meshing on inward lateral movement with rack gear teeth of the gate segment mounted on hinges and the gear teeth section attached to spring means and the spring means attached to lateral slot in top bar section of gate segment mounted for lateral sliding and a release lever attached to the spring means to manually release meshing of gear teeth section with rack gear teeth to allow lateral inward movement of the sliding gate segment and the gear teeth section sliding freely over gear rack teeth when sliding gate segment moves laterally outward.

Another object of this invention is to disclose in adjustable width doorway safety gate apparatus comprised of two gate segments aligned and attached together for lateral sliding of one gate segment on the other wherein the improvement comprises doorway pillar straddle U frame sections extending horizontally outwardly and attached to outer vertical frame section of a lateral sliding gate segment.

Another object of this invention is to disclose a gate latch lock means comprised of stiffly flexible plastic material such as nylon, polypropylene or polystyrene.

Another object of this invention is to disclose an adjustable width safety gate mounted on hinges comprised of downward pointing hinge pins and these hinge pins fitting in hinge pin socket sections which hinge pin sockets are mounted on a face plate attached to the doorway pillar by means of L shaped legs straddling the doorway pillar and attached to the face plate.

Another object of this invention is to disclose hinge pin mount sockets attached to a hinge pin socket mount plate having slits in the mount plate and the mount plate is attached to the doorway pillar by means of legs of L shape side wings with offset finger section of the L shape legs fitting in the slits of the mount plate and the legs of L shape side wing to contact the mount plate and L shape side wing sections attached to side of doorway pillar by means of a threaded bolt threaded into threaded nut on leg of L shape side wing.

PRIOR ART PERTAINING TO THIS INVENTION

U.S. Pat. No. 139,232 to Boughton for "Nursery Gates"—This patent discloses an expandable gate which locks on one end.

U.S. Pat. No. 141,677 to Tuttle for "Nursery Gates". This patent discloses an adjustable width gate which is raised to open and lowered for closing—no hinges are involved.

U.S. Pat. No. 4,492,263 to Gebhard for "Infant Security Door Gate Assembly". This gate is an assembly of two segments, expandable by sliding on telescoping rods.

U.S. Pat. No. 942,502 to Jablonovsky for "Adjustable Window Grate". This discloses two pairs of gate sections, with the two pairs to be fitted together.

Other patents of interest are:

U.S. Pat. No. 2,662,242 to Hess
U.S. Pat. No. 4,465,262 to Itri
U.S. Pat. No. 4,566,222 to Hatvany
U.S. Pat. No. 4,607,455 to Bluem
U.S. Pat. No. 2,896,277 to Halligan
U.S. Pat. No. 4,149,342 to Bowers
U.S. Pat. No. 4,573,285 to Jokel.

Foreign Patents are:

UK Pat. No. 2,041,051 to Adams for "Baby Gates". This is for an adjustable width gate, hinged on one end and locking on the opposite end.

Patent (French) No. 1,236,542 to Perrier see FIGS. 1-7. This barrier does not swing free.

None of the above patents touch the disclosure of this present invention as described below.

DESCRIPTION OF DRAWINGS

Figure 1:
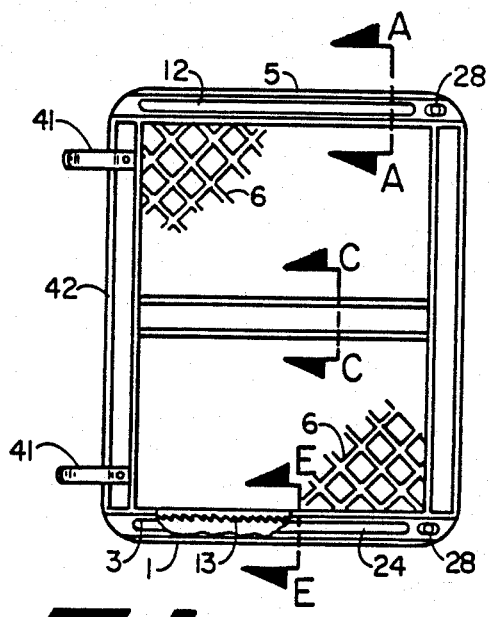
FIG. 1—Gate half segment lateral sliding segment.

FIG. 1—Gate half segment—lateral sliding segment.

1—Sliding gate half segment of safety gate

3—Bottom bar section

Figure 2:
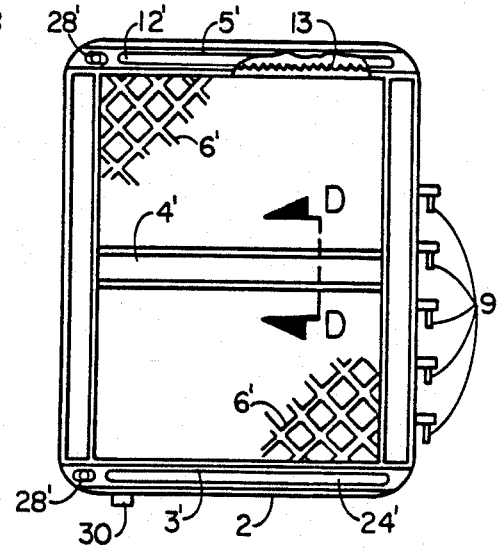
FIG. 2—Gate half segment—hinged segment.
Figure 3:
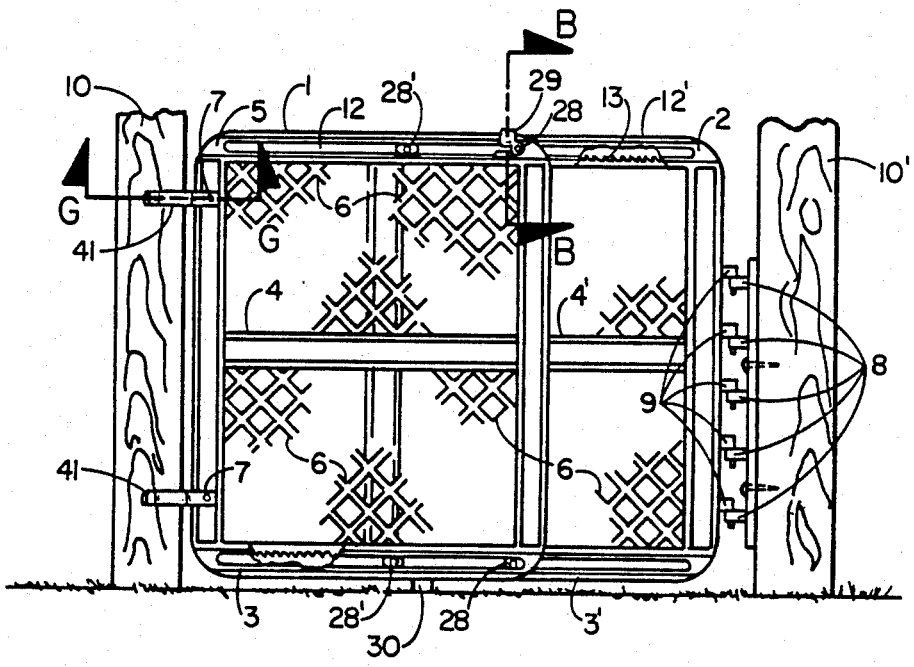
FIG. 3—Assembled adjustable width doorway safety gate apparatus.
Figure 4:
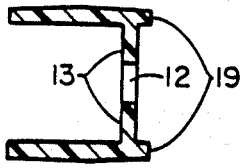
FIG. 4—Cross section view A—A of FIG. 1 top bar segment.
Figure 5:
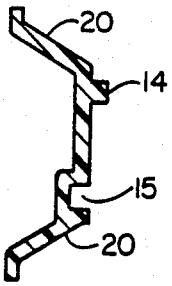
FIG. 5—Cross section view C—C of FIG. 1, center bar segment.
Figure 6:
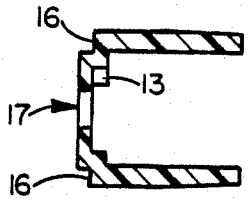
FIG. 6—Cross section view E—E of FIG. 1 bottom bar segment.
Figure 7:
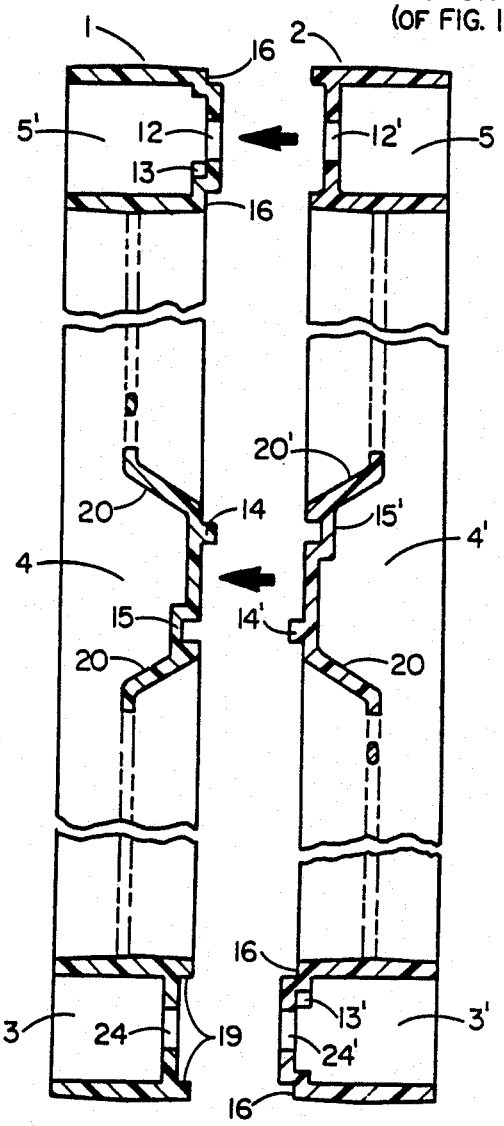
FIG. 7—Cross section view of top, center and bottom bar sections of gate segments in exploded view showing fitting of tongues and grooves.
Figure 8:
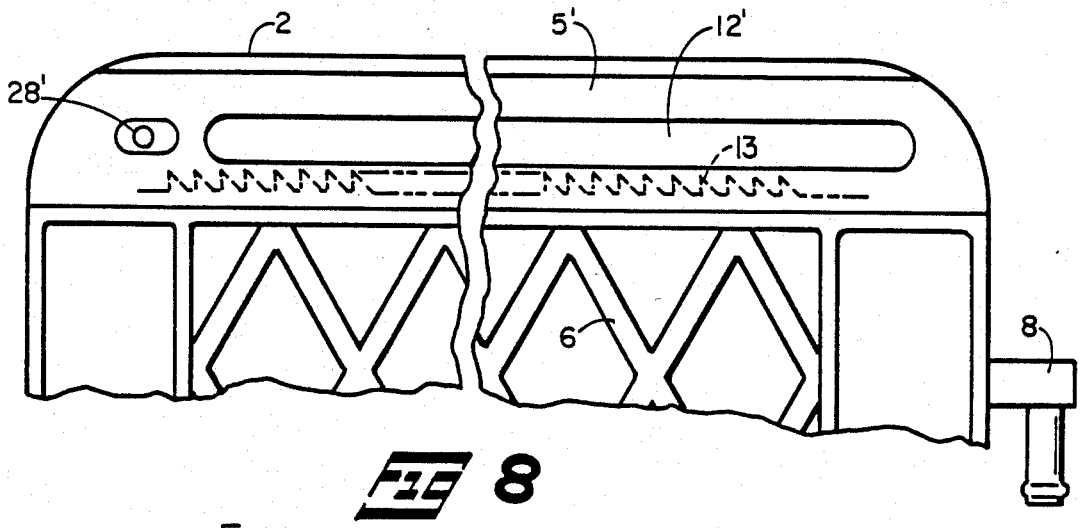
FIG. 8—Enlarged elevation view of top bar section of gate half segment which is the hinged gate segment.

4—Center bar section
5—Top bar section
6—Grill work in gate segment
12—Slot in top bar section
18—Gate latch lock
24—Slot in bottom bar section
41—U section to straddle door pillar FIG. 2—Gate half segment—hinged segment.
2—Hinged gate half segment of safety gate
3'—Bottom bar section
4'—Center bar section
5'—Top bar section
6'—Grill work in gate segment
12'—Slot in top bar section
13—Gear rack teeth
18—Gate latch
30—Bottom foot on hinged gate half segment
24'—Slot in bottom bar section
29—Gate latch lock location FIG. 3—Assembled adjustable width doorway safety gate apparatus comprising:
1—Sliding gate half segment of safety gate
2—Hinged gate half segment of safety gate
3,3'—Bottom bar segments of safety gate
4,4'—Center bar segments of safety gate
5,5'—Top bar segments of safety gate
6,6'—Grill work in segments of safety gate
7—Gate latch
8—Hinge pin sockets
9—Hinge pins
10,10'—Doorway pillars
11—Hinge pin socket mount bracket
12,12'
Slots in top bar sections of gate half segments tongue and groove sections in center bar sections of gate half segments
13—Gear rack teeth
30—Bottom foot on hinged gate half segment
28—Location of gate latch lock
41—U section to straddle doorway pillar FIG. 4—This is cross section view A—A of FIG. 1, top bar segment 5 wherein:
12—Slot in top bar section of gate half segment
13—Flange web of top bar section
19—Tongue sections of top bar section FIG. 5—Cross section view C—C of FIG. 1, center bar segment 4 wherein:
14—Tongue of center bar segment
15—Groove of center bar segment
20—Arms extending from center bar gate section to grill work of gate segments FIG. 6—Cross section view E—E of FIG. 1, bottom bar segment 3, wherein:
16—Recesses for fitting of tongues 19
17—Slot in bottom bar section of gate half segment FIG. 7—Cross section view of top, center and bottom bar sections of gate segments in expanded view showing fitting of tongues and grooves when one gate half segment is inverted for fitting lateral sliding gate segment to hinged gate half segment.
1—Lateral sliding gate half segment
2—Gate half segment—hinged segment
3,3'—Bottom gate sections of gate half segments
4,4'—Center bar gate sections
5,5'—Top bar sections of gate half segments
12,12'—Matching slots in top bar sections of gate half segments fitting together
13—Gear rack tooth section to mesh with tooth section
16—Recesses in top and bottom bar sections of gate half segments
19—Tongue sections fitting in grooves 16 of top and bottom bar sections
20,20'—Arms extending from center bar gate section to grill work of gate segments
24,24'—Matching slots in bottom bar sections of gate half segments fitting together FIG. 8—Enlarged elevation view of top bar section of gate half segment which is the hinged gate segment wherein:
2—Hinged gate half segment of safety gate
5'—Top bar segment of hinged gate half segment
6—Grill in gate segment
8—Hinge pin
12—Slot in top bar section of hinged gate half segment
13—Gear rack teeth
28—Double headed pin attched to top bar section of hinge gate half segment 2 and extending through slot in gate half segment 1 top bar section.

Figure 9:
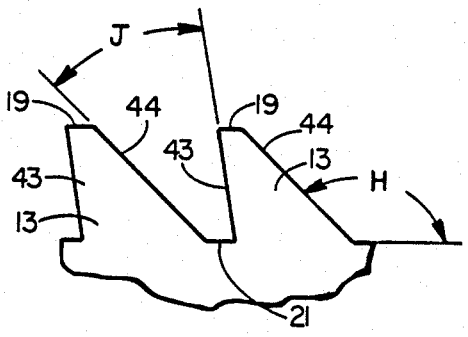
FIG. 9—Enlarged plan view of gear rack tooth section.
Figure 10:
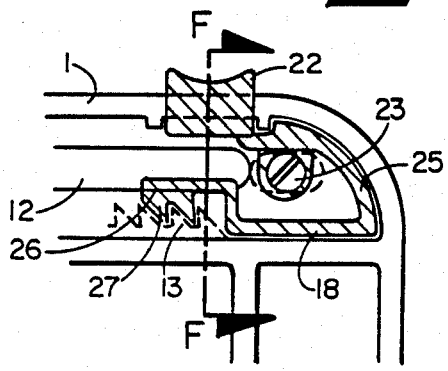
FIG. 10—Enlarged elevation view of location of lateral sliding gate latch lock.
Figure 11:
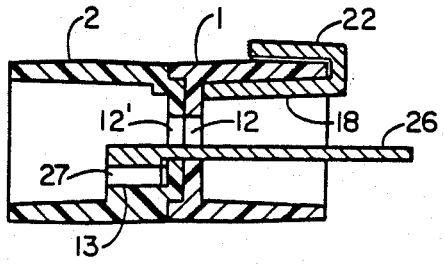
FIG. 11—Enlarged cross section view F—F of FIG. 10.
Figure 12:
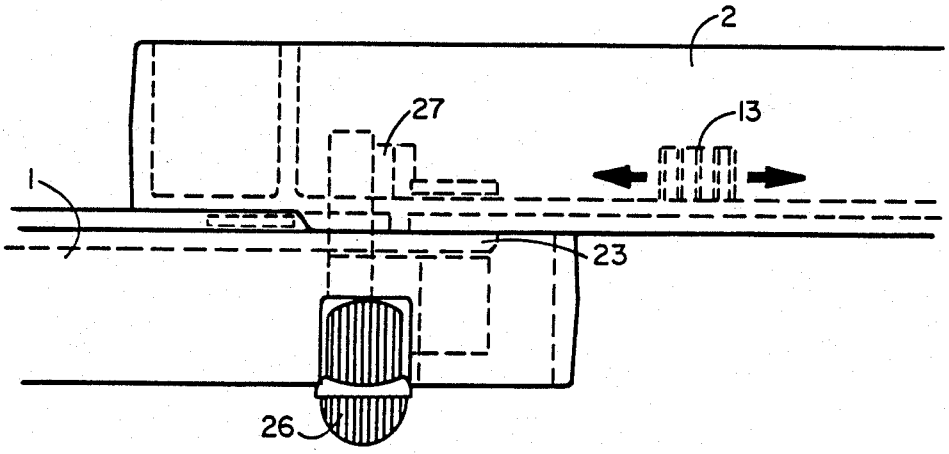
FIG. 12—Enlarged plan view of portion of assembled adjustable gate.
Figure 13:
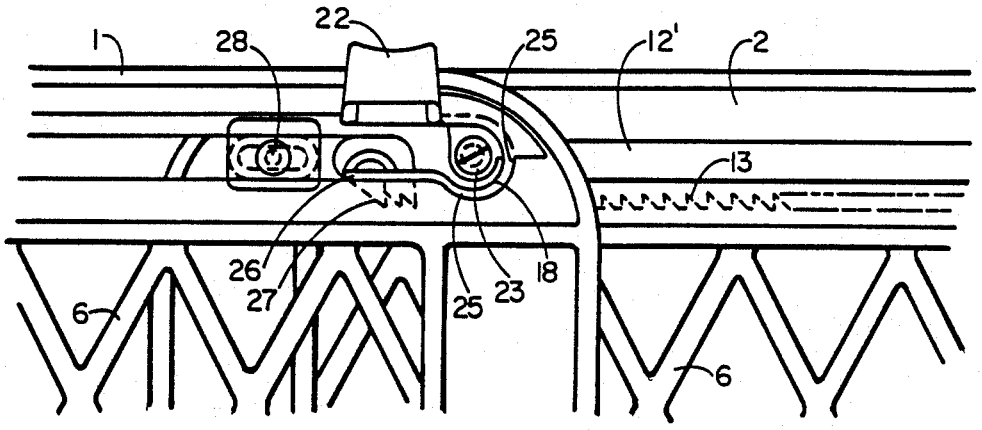
FIG. 13—Enlarged elevation view of portion of assembled adjustable gate.
Figure 14:
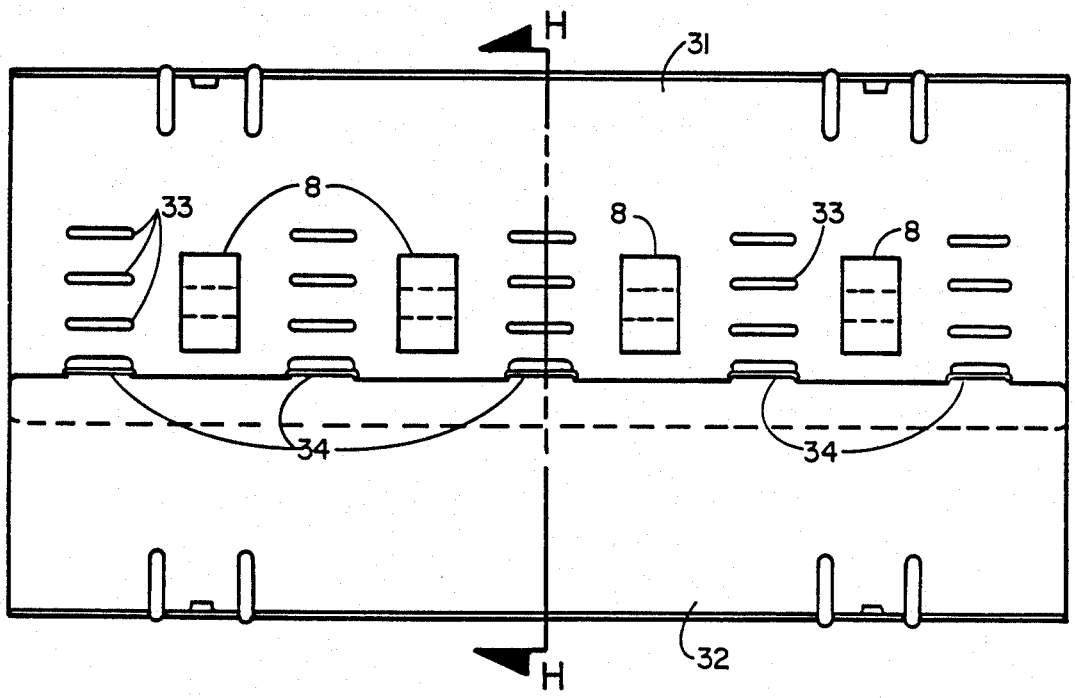
FIG. 14—Elevation view of face of hinge mount plate.

FIG. 9—Enlarged plan view of gear rack tooth section.
13—Gear rack teeth
19—Flat at top of gear rack teeth
21—Flat land at base between gear rack teeth
H—Angle of 45 degrees of gear rack teeth ratchet side
J—Angle of 80 degrees of gear rack teeth catch side FIG. 10—Enlarged elevation view of location of lateral sliding gate latch lock.
1—Lateral sliding gate half segment of safety gate
12—Slot in top bar section
13—Gear rack teeth in top bar section of hinged gate half segment
18—Gate latch lock
22—Overlapping flange of latch lateral sliding gate latch
23—Anchor screw for gate latch and pin extending through slot of top bar section of hinged gate half segment
25—Gate latch spring section
26—Latch release lever
27—Gear teeth section of latch FIG. 11—Enlarged cross section view F—F of FIG. 10 wherein:
1—Lateral sliding gate half segment of safety gate
2—Hinged gate half segment of safety gate
12,12'—Matching slots in top bar sections of safety gate
13—Gear rack teeth
18—Gate latch
22—Overlapping flange of latch on lateral sliding gate latch
26—Latch release lever
27—Gear teeth section FIG. 12—Enlarged plan view of portion of assembled adjustable gate showing enlarged portion of gate latch wherein:
1—Lateral sliding gate half segment of safety gate
2—Hinged gate half segment of safety gate
13—Gear rack teeth
18—Gate latch
23—Screw for latch mount on lateral sliding gate segment
26—Latch release lever
27—Gear teeth section FIG. 13—Enlarged elevation view of portion of assembled adjustable gate showing portion of gate release lock wherein:
1—Lateral sliding gate half segment of safety gate
2—Hinged gate half segment of safety gate
6—Grill work of safety gate
13—Gear rack teeth
18—Gate latch
23—Screw for latch mount on lateral sliding gate segment
25—Latch stiffly flexible arm section
26—Latch release lever
27—Gear teeth section
28—Double headed pin extending through matching slots FIG. 14—Elevation face of hinge mount plate wherein:
8—Hinge pin sockets
31—Face plate section with slits
32—Face plate section with offset fingers
33—Slits for adjusting width
34—Offset fingers (mounted in slots)

Figure 15:
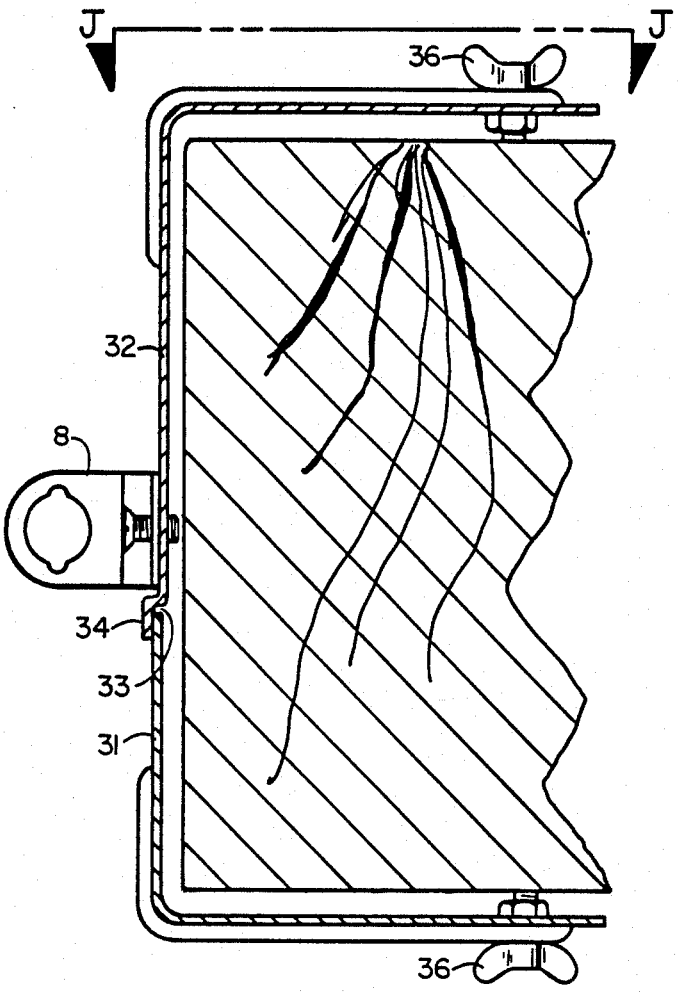
FIG. 15—Section H—H of FIG. 14.

FIG. 15—Section H, H of FIG. 14.
8—Hinge pin socket mount
31—Face plate section with slits
32—Face plate section with offset fingers
33—Slit for adjusting width
34—Offset finger (mounted in slit 33)

Figure 16:
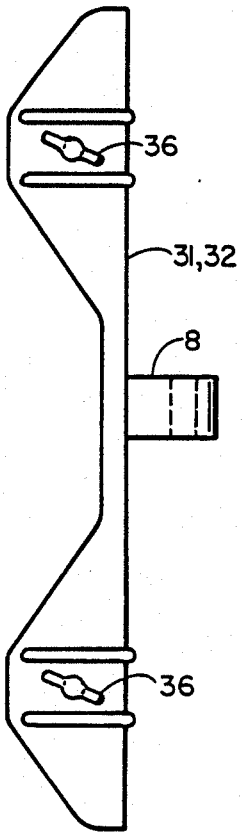
FIG. 16—Side wing mount of hinge socket face plate (section view J—J of FIG. 15.)
Figure 17:
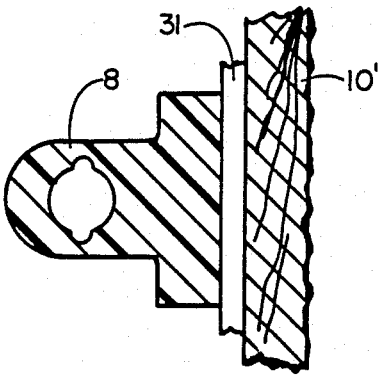
FIG. 17—Hinge pin socket plan view.
Figure 18:
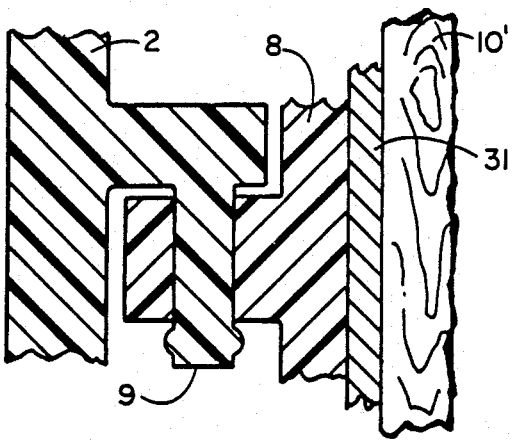
FIG. 18—Elevation view of assembled hinge pin in hinge pin socket.
Figure 19:
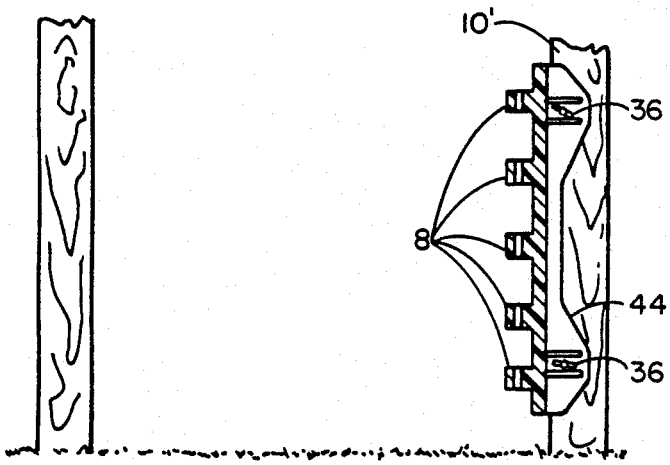
FIG. 19—Side elevation view of hinge pin sockets attached to mount face plate, and this assembly mounted on door frame pillar.
Figure 20:
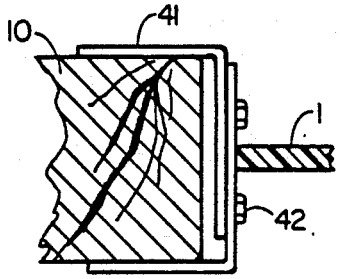
FIG. 20—Plan view of U section fastened to outer vertical edge of lateral sliding gate segment (Section G—G of FIG. 1).
Figure 21:
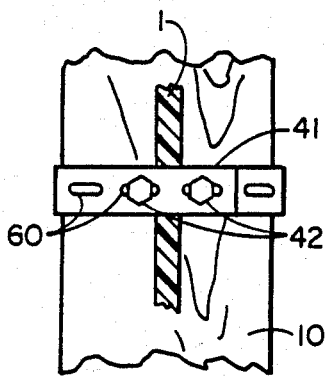
FIG. 21—Elevation view of U section adjustable for width.
Figure 22:
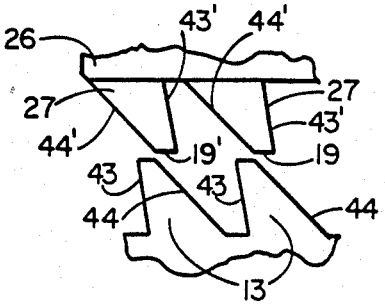
FIG. 22—Isolated enlarged elevation view of relation of gear latch tooth section and gear rack tooth section in over ride or ratcheting position.
Figure 23:
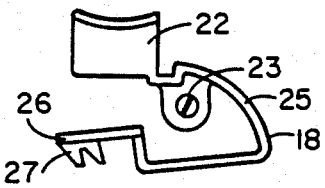
FIG. 23—Isolated elevation view of gate latch release of lateral sliding gate segment.
Figure 24:
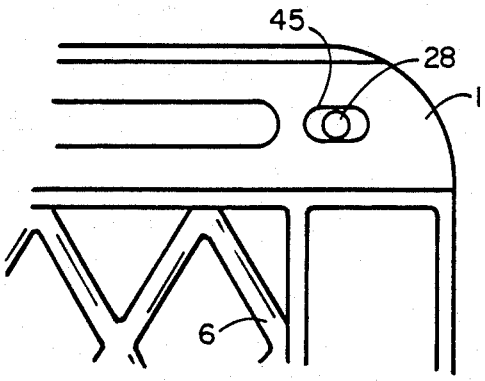
FIG. 24—Enlarged elevation view of double headed pin extending from one gate segment corner through slot of other gate segment to hold gate segments in lateral sliding position.
Figure 25:
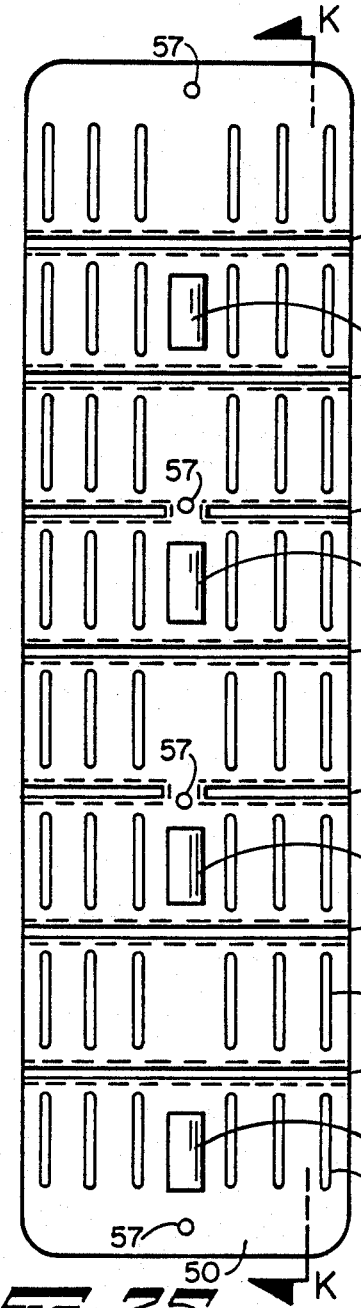
FIG. 25—Front elevation view of hinge pin socket mount plate on doorway pillar.
Figure 26:
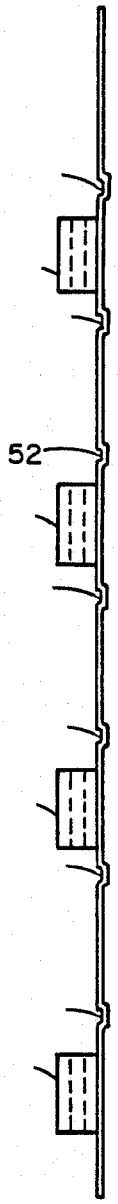
FIG. 26—Cross section K—K view of hinge pin socket mount plate.
Figure 27:
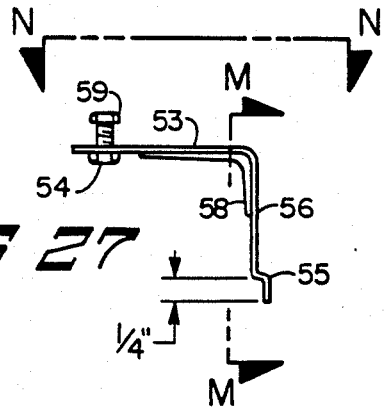
FIG. 27—Side wing attachment on hinge pin socket mount plate.

FIG. 16—Side wing mount of hinge socket face plate (section view J, J of FIG. 15).
8—Hinge pin socket
31,32—Location of face plate
35—Side wing of face plate
36—Adjustable screws to tighten on door pillar FIG. 17—Hinge pin socket plan view
8—Hinge pin socket
10'—Doorway pillar
31—Face plate section FIG. 18—Elevation view of assembled hinge pin in hinge pin socket
2—Hinged gate half segment of safety gate
8—Hinge pin socket
9—Hinge pin
10'—Doorway pillar
31—Face plate section FIG. 19—Side elevation view of hinge pin sockets attached to mounting face plate, and this assembly mounted on door frame pillar:
8—Hinge pin sockets
9—Hinge pin
10'—Doorway pillar
31—Face plate section
36—Adjustable screws to tighten against door pillar
37—Door pillar FIG. 20—Plan view of U section fastened to outer vertical edge of lateral sliding gate segment wherein (Section G—G of FIG. 1)
1—Sliding gate half segment of safety gate
10—Doorway pillar
41—U section attached to outer vertical edge of lateral sliding gate half segment to straddle doorway pillar
42—Screws in slots of U section to allow adjustment of width to straddle doorway pillar FIG. 21—Elevation view of U section adjustable for width wherein:
1—Vertical outer edge of lateral sliding gate half segment of safety gate
10—Doorway pillar
41—U section attached to outer vertical edge of lateral sliding gate half segment to straddle doorway pillar
42—Screws in holes of U section to allow adjustment of width to straddle doorway pillar
60—Holes in U section to allow width adjustment to straddle doorway pillar FIG. 22—An isolated enlarged elevation view of relation of gear latch tooth section and gear rack tooth section shown in over ride or ratcheting position wherein:
13—Gear rack teeth
19,19'—Flat at top of gear rack teeth and gear tooth section
26—Latch release lever
27—Gear teeth section
43,43'—Gear meshing side of gear tooth sections
44,44'—Ratcheting side of gear tooth sections FIG. 23—Isolated elevation view of gate latch release of lateral sliding gate segment wherein:
18—Gate latch
22—Overlapping flange of latch of lateral sliding gate segment
23—Anchor screw for gate latch and pin extending through slot of top bar section of hinged gate half segment
25—Gate latch spring section
26—Latch release lever
27—Gear teeth section of latch FIG. 24—Enlarged elevation view of double headed pin extending from one gate segment corner through slot of other gate segment to hold gate segments in lateral sliding position wherein:
1—Lateral gate sliding segment
28—Double headed pin for lateral sliding gate FIG. 25—Front elevation view of hinge pin socket mount plate on doorway pillar wherein:
50—Hinge pin socket mount plate
51—Slits in mount plate
52—Cross channels in mount plate
8—Hinge pin sockets mounted on mount plate
57—Screw holes for attaching mount plate to doorway pillar FIG. 26—Cross section K—K view of hinge pin socket mount plate wherein:
8—Hinge pin sockets
50—Section K—K elevation view of hinge mount plate
52—Cross channels in mount plate FIG. 27—Side wing attachment on hinge pin socket mount plate to attach mount plate to doorway pillar wherein:
58—L shape side wing
53—Leg of L shape side wing to contact side of doorway pillar
54—Threaded nut on leg of L shape side wing to contact side of doorway pillar
56—Leg of L shape side wing to contact mount plate
55—Offset finger section of leg of L shape side wing in contact with mount plate
59—Threaded screw bolt section to turn into threaded nut 54

Figure 32:
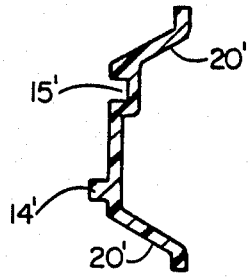
FIG. 32—Cross section view D—D of FIG. 2 center bar section of hinged gate segment.
Figure 28:
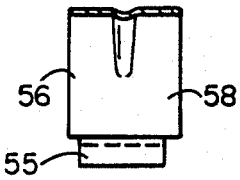
FIG. 28—L shape side wing segment section M—M view.
Figure 29:
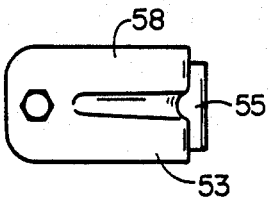
FIG. 29—L shape side wing segment section view N—N.
Figure 30:
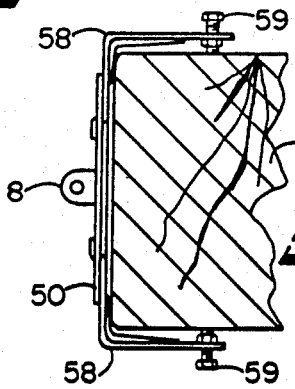
FIG. 30—Plan view of hinge pin socket mount plate and L shaped side wing segment.
Figure 31:
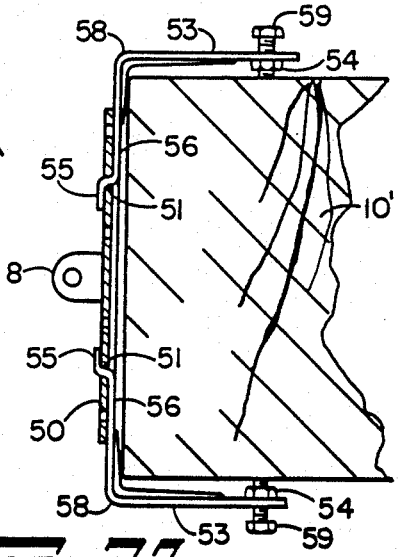
FIG. 31—Enlarged plan view of fitting of hinge pin socket mount plate and side wing attachments for attaching to doorway pillar.

FIG. 28—L shape side wing segment section M—M view, wherein:
53—Leg of L shape side wing to contact side of doorway pillar
56—Leg of L shape side wing to contact mount plate 55—Offset finger section of leg of L shape side wing in contact with mount plate
58—L shape side wing segment FIG. 29—L shape side wing segment section view N—N wherein:
58—L shape side wing segment
53—Leg of L shape side wing to contact side of doorway pillar
55—Offset finger section of leg of L shape side wing in contact with mount plate FIG. 30—Plan view of hinge pin socket mount plate and L shaped side wing segment wherein:
50—Hinge pin socket mount plate
58—L shape side wing segment
8—Hinge pin socket
10'—Doorway pillar
59—Threaded screw bolt FIG. 31—Enlarged plan view of fitting of hinge pin socket mount plate and side wing attachments for attaching to doorway pillar wherein:
10'—Doorway pillar
50—Hinge pin socket mount plate
51—Slits in mount plate
53—Leg of L shape side wing
55—Offset finger section of leg of L shape side wing
56—Leg of L shape side wing to contact mount plate
58—L shape side wing segment
59—Threaded screw bolt
54—Threaded nut
8—Hinge mount socket
10'—Door frame pillar FIG. 32—Cross section view D—D of FIG. 2 center bar section of hinged gate segment wherein:
14'—Tongue of center bar segment of hinged gate half segment to fit into groove 15 of FIG. 5
15'—Groove of center bar segment of hinged gate half segment to fit tongue 14 of FIG. 5
20'—Arms extending from center bar gate section to grill work of gate segments The above description of the drawings includes identification of component parts of the legends noted, to disclose the parts and assembly of this invention.

In general, where numbers and their primes are used, this indicates similar components in the gate segments.

The gear rack teeth in the lateral sliding gate segment bottom are of no function and merely indicates how the segment is inverted to match the sliding surfaces of the gate segments.

DETAILED DESCRIPTION OF INVENTION

In the description of this invention, teeth and tooth may be used interchangeably, but will have the same meaning. Gate half segments may be identified as gate segments or as a gate segment, but having the same meaning.

The adjustable width doorway safety gate may be fabricated of any type material but this disclosure is particularly amenable to assembly of such a gate from a plastic molding wherein one cavity can supply both the gate half segment mounted on hinges and a laterally sliding gate half segment fitting onto the hinge mounted gate half segment and tongues and grooves are meshed merely by inverting the lateral sliding gate half segment, and attaching the gate half segments together by means of double headed pins extending through aligned slots of the two gate half segments.

Hinge pins are molded onto the hinge mounted gate half segment and for molding the laterally sliding gate half segment, the hinge pins are blocked off in the molding die or else the hinge pins molded onto the gate half segment can be removed by cutting off of the hinge pin component.

Adjustable width doorway safety gate apparatus of this invention comprises two gate half segments 1 and 2 aligned and attached together for lateral sliding of gate half segment 1 on gate half segment 2. Gate half segment 1, can be otherwise identified as lateral sliding gate segment and gate half segment 2 can be otherwise identified as hinge gate segment. The gate half segments 1 and 2 have aligned lateral slots 12,12' in top bar sections 5,5' and bottom bar sections 3,3' have aligned lateral slots 24,24' and double headed cross pins extending through the aligned lateral slots 12,12' and 24,24' of aligned gate segments 1 and 2, and top bar sections 5,5', center bar sections 4,4' and bottom bar sections 3,3' of the gate half segments 1, 2 fitting together in matching tongues 25,25', 27,27' and grooves 28,28', 26,26' for lateral sliding and rack gear teeth 13 mounted in length of slot 12' of top bar section 5' of gate half segment 2 mounted on hinges comprised of downward projecting hinge pins 9 mounted on outer vertical gate half segment 2 and the hinge pins mounting into hinge pin sockets 8 and the hinge pin sockets 8 attached to face plate 31,32 mounted on door frame pillar 10'.

To prevent sagging of assembled gate segments, there is a bottom foot on hinged gate half segment 2. This bottom foot 30 is attached to the bottom of outer edge of hinged gate half segment 2 as shown in FIG. 3.

Further description of adjustable width doorway safety gate comprises two gate half segments 1 and 2, one segment 2 mounted on hinges 8,9 and segment 1, mounted for lateral sliding on segment 2 mounted on hinges 8,9 and matching lateral slots 12,12' in the two gate segments 1 and 2 of top bar sections 5,5' and slots 24,24' in bottom bar sections 3,3' and double headed cross pins 28 extending through the lateral slots 12,12' and 24,24' of aligned gate segments 1 and 2. Top bar sections 5,5' center bar sections 4,4' and bottom bar sections 3,3' of the two gate half segments 1 and 2 fitting together in matching tongues 14,14' and 16,16' and grooves 15,15' and 19,19' FIG. 7 for lateral sliding and gear rack teeth 13, mounted for length of slot 12' of top bar section as shown in FIGS. 8 and 11 of gate half segment 2 mounted on hinges 8 and 9 and means to engage the gear rack teeth 13 of hinge mounted gate half segment to stop inward lateral movement of sliding gate half segment 1 the means comprising gear tooth section 27 to mesh with the rack gear teeth 13 and the section of gear teeth 27 mounted on gate latch spring section 25 to mesh with the rack gear tooth section 13 and a latch release lever 26 attached to the latch spring section 25 to disengage the gear tooth section 27 from the rack gear teeth 13 to allow lateral inward movement of sliding gate segment 1 and door pillar straddle U section 41 of FIG. 20 attached to outer vertical edge 42 FIG. 1 of the lateral sliding gate half segment 1 to hold the gate in closed position, (FIG. 3).

In the description of this invention, reference is made to a doorway pillar straddle U frame section. This "U" form is used to represent a square based form the base of which is adjustable for fitting over doorway pillar 10. (See FIGS. 20 and 21).

The means to engage gear rack teeth 13 mounted in length of slot 12' of top bar section 5' of gate half segment 2 mounted on hinges 8 and 9, to stop inward lateral movement of gate half segment 1, consisting of gear teeth section 27 meshing with rack gear teeth 13 of the gate segment 2 mounted on hinges 8 and 9 and the gear tooth section 27 attached to gate latch spring section 25 and the spring section 25 attached to inner end of slot in top bar section 12 in top bar section 5 of gate half segment 1 mounted for lateral sliding on gate half segment 2 mounted on hinges 8 and 9 and a release lever 26 attached to the spring section 25 for release of meshing of gear teeth section 27 with rack gear teeth section 13 to allow lateral inward movement of the lateral sliding gate half segment 1 and the gear teeth section 27 sliding or ratcheting freely over gear rack teeth 13 when sliding gate half segment moves laterally outward, to engage U lock sections to straddle door frame pillar 10 to hold the assembled gate in closed position. (FIG. 3).

The rack gear teeth 13 have a flat land 21, at the base between gear rack teeth having a dimension to accommodate the crown or top of teeth of gear teeth section 27.

The rack gear teeth are located as shown in FIGS. 8 and 11 next to and parallel with slot 12', thus the rack gear teeth are adjacent to the slot 12'.

The gear teeth section 27 acts as a pawl ratchet in which the teeth mesh with gear rack teeth 13, on lateral movement of gate segment 1 to prevent inward lateral movement, but on lateral movement of gate segment 1 outward the teeth do not mesh but allow for movement outward.

The pawl ratchet acting gear tooth section 27 is so identified that when the lateral sliding gate segment 1 is moved outward the pawl ratchet gear tooth section 27 slides over gear rack teeth 13 in gate segment 2 without the necessity of lifting latch release lever 26.

Reference is made to FIG. 9 to further describe the rack gear tooth section. The face 43 of the gear rack teeth 13 which mesh with the teeth of gear tooth section 27 have an angle J of less than 90° preferably about 80°, and the teeth of gear teeth section 27 have the same angle of less than 90° preferably about 80° so that the teeth mesh to hold the adjustable width doorway safety gate to its adjusted width and is retractable only on release of latch gear teeth section 27 from the gear rack teeth by means of activation of latch release lever 26.

The above discussion mentions the hinges which are comprised of hinge pins 9 mounted in hinge pin sockets 8. Referring to FIG. 19 which is a side elevation view of hinge pin sockets 8 attached to mounting face plate 31 and side wings 44 perpendicular to the face plate 31 and threaded pin sections 36 mounted in threaded section 46 of side wings 35.

The mounting face plate 31 is adjustable for various doorway pillar widths by fitting of offset fingers in slits of face plate 31.

Reference is now made to U.S. Pat. No. 4,702,036 to describe in detail the hinge components for mounting of the gate.

The lateral sliding gate latch mechanism is shown in FIGS. 10, 11, 12, 13 and 23 and is comprised of the mechanism as shown and described in FIG. 23 description, and the teeth of the gear tooth section are as described above and as shown in FIG. 22 to mesh and ratchet with the tooth section of gear rack section which section is shown in FIG. 9 and the teeth of the gear tooth section of the latch and the teeth of the rack gear section are of approximately the same configuration.

The gate latch mechanism 18 as shown comprises a plastic molding having sections of overlapping flange of latch 22 and gate latch spring section 25 latch release lever 26, and gear tooth section 27 and this is latch mounted on the top bar section 5 of lateral sliding gate half segment 1 of safety gate by means of a bolt or screw fastener 23 in such manner that gear tooth section 27 of the latch mesh with the gear rack teeth 13, of gate half segment of safety gate 2, which is the hinged section. The gate latch 18 is located on lateral sliding gate half segment 1, at 29 of FIG. 2. Spring section 25 amounts to stiffly flexible plastic material such as nylon, polypropylene or polystyrene to insure meshing of gear teeth 27 and gear rack teeth 13 until released by actuation of lever 26.

It is to be pointed out that the double headed cross pins 28 which hold the lateral sliding gate half segment 1, onto the hinged gate half segment 2, comprises four double headed cross pins, two of which cross pins 28,28 are rigidly attached to lateral sliding gate half segment 1, and these pins extend through the slots in top bar section 12' and bottom bar section 24' of hinged gate half segment 2, and two double headed pins 28',28' are rigidly attached to hinged gate half segment 2, and extend through slots in top bar section 12, and lower bar section 24 of lateral sliding gate segment 1. The rigidly attached pins, mentioned above are located in the top bar sections 5,5', and bottom bar sections 3,3', and extend through respective slots 12,12' and 24,24' in top and bottom bar sections. Pins 28 are located as shown in FIG. 2.

As an alternative to mounting the adjustable width doorway safety gate, the hinge pin mount sockets 8 are attached to hinge pin socket mount plate 50 having slits 51 in the mount plate and the mount plate 50 is attached to doorway pillar 10' by means of legs 53 of L shape side wings 58, with offset finger section of legs of L shape 55 fitting in slits 51, The leg of L shape side wing 56 to contact mount plate 50, and L shape side wing sections 58, attached to side of doorway pillar 10' by means of threaded bolt 59 threaded into threaded nut 54. The hinge mount sockets 8 are attached to mount plate 50 by means of screws 57. (See FIGS. 25, 26, 27, 28, 29, 30 and 31).

The drawing legends identify and describe the components of this invention, and with the description, enables those knowledgeable in the art to make the apparatus of this invention.

Having described my invention, I claim:

1. Adjustable Width doorway safety gate apparatus wherein the improvement comprises:

a—two gate half segments aligned and attached together for lateral sliding of one gate half segment on the other, and b—said two gate half segments having aligned lateral slots in c—top bar sections and bottom bar sections in each gate segment and d—double headed cross pins extending through said lateral slots of aligned gate segments and e—top bar sections, center bar sections and bottom bar sections of said two gate segments fitting together in matching tongues and grooves, for lateral sliding, and f—rack gear teeth mounted for length and parallel to slot of top bar section, and g—one gate half segment mounted on hinges comprised of downward projecting hinge pins mounted on outer vertical gate half segment and h—said hinge pins mounting into hinge pin sockets and i—said hinge pin sockets attached to a face plate mounted on a door frame pillar, and j—a bottom foot on hinged gate half segment.

2. Adjustable width doorway safety gate apparatus wherein the improvement comprises:

a—two gate half segments, one segment mounted on hinges and one segment mounted for lateral sliding on said segment mounted on hinges and b—matching lateral slots in said two gate segments of c—top bar sections and bottom bar sections and d—double headed cross pins extending through said lateral slots of aligned gate segments and e—top bar sections, center bar sections and bottom bar sections of said two gate half segments fitting together in matching tongues and grooves, for lateral sliding, and f—rack gear teeth mounted in top bar section of gate segment mounted on hinges and g—gate latch lock means to engage said rack gear teeth mounted in top bar section of said gate half section mounted on hinges and h—said gate latch lock means consisting of gear teeth section meshing with rack gear teeth of said gate segment mounted on hinges, and i—said gear teeth section attached to spring means and said spring means j—attached to inner end of lateral slot in top bar section of gate segment mounted for lateral sliding on gate half segment mounted on hinges and k—release lever attached to said gate latch lock spring means l—for release of meshing of gate latch lock gear teeth section with rack gear teeth to allow lateral inward movement of said sliding gate segment, m—and said gear teeth section sliding freely over gear rack teeth when sliding gate half segment moves laterally outward.

3. Adjustable width doorway safety gate apparatus of claim 2, wherein the improvement comprises:

a—gate latch means to engage rack gear teeth of hinge mounted gate segment and b—said means comprising a section of gear teeth to mesh with rack gear teeth and said section of gear teeth mounted on spring means and c—a release lever attached to said spring means to disengage gear teeth section from said rack gear teeth to allow lateral inward movement of sliding gate segment, and d—door pillar straddle (U) sections attached to outer vertical edge of said lateral sliding gate segment to hold gate in closed position, and e—a bottom foot on hinged gate half segment.

4. Adjustable width doorway safety gate apparatus of claim 2 wherein the improvement comprises:

a—doorway pillar straddle (U) frame sections extending outwardly and attached to outer vertical frame section of said lateral sliding gate segment, and b—gate hinge sockets attached to adjustable width face plate comprised of hinge pin sockets, and c—a face plate section with slits and d—a face plate section with offset fingers and e—said offset fingers fitting in said slits of said face plate section and f—side wings on said face plates and g—adjusting screws mounted on said side wings.

5. Adjustable width doorway safety gate apparatus of claim 2 wherein the improvement comprises a gate latch lock means of stiffly flexible plastic material selected from the group consisting of nylon, polypropylene or polystyrene.

6. Adjustable width doorway safety gate apparatus of claim 2 comprised of two gate segments aligned and attached together for lateral sliding of one gate segment on the other wherein the improvement comprises:

a—door frame pillar straddle (U) frame sections extending outwardly and attached to outer vertical frame section of said lateral sliding gate segment, and b—gate hinge sockets attached to adjustable width face plate comprised of hinge pin sockets and c—a face plate section with slits and d—a face plate section with offset fingers and e—said offset fingers fitting in said slits of said face plate section and f—side wings on said face plates and g—adjusting screws mounted on said side wings.

7. Adjustable width doorway safety gate apparatus of claim 2 wherein the improvement comprises:

a—hinge pin mount sockets attached to a hinge pin socket mount plate, and b—slits in said mount plate and c—said mount plate attached to doorway pillar by means of d—legs of (L) shape with offset finger section of said (L) shape legs fitting in said slits and e—the leg of (L) shape to be in contact with said mount plate and f—(L) shape sections attached to side of said doorway pillar by means of a threaded bolt threaded into threaded nut attached to said side wing section.

8. Adjustable width doorway safety gate apparatus of claim 2, wherein the improvement comprises:

a—rack gear teeth mounted in top bar section of gate segment mounted on hinges and b—said rack gear teeth located next to and parallel with slot in said top bar section.

* * * * *